US006532753B2

(12) United States Patent
Watanabe et al.

(10) Patent No.: US 6,532,753 B2
(45) Date of Patent: Mar. 18, 2003

(54) EXPANSION VALVE

(75) Inventors: Kazuhiko Watanabe, Tokyo (JP); Hiroshi Hayashi, Tokyo (JP)

(73) Assignee: Fujikoki Corporation, Tokyo (JP)

( * ) Notice: Subject to any disclaimer, the term of this patent is extended or adjusted under 35 U.S.C. 154(b) by 0 days.

(21) Appl. No.: 10/119,209

(22) Filed: Apr. 10, 2002

(65) Prior Publication Data

US 2002/0109012 A1 Aug. 15, 2002

Related U.S. Application Data

(62) Division of application No. 09/247,545, filed on Feb. 10, 1999, now Pat. No. 6,394,360.

(30) Foreign Application Priority Data

Apr. 2, 1998 (JP) ..... H10-89878

(51) Int. Cl.[7] ..... G05D 27/00; F25D 41/04
(52) U.S. Cl. ..... 62/115; 62/225; 236/92 B
(58) Field of Search ..... 62/225, 115, 296; 236/92 B

(56) References Cited

U.S. PATENT DOCUMENTS

| | | | |
|---|---|---|---|
| 2,327,542 | A | 8/1943 | Matteson |
| 3,537,645 | A | 11/1970 | Treder |
| 4,542,852 | A | 9/1985 | Orth et al. |
| 5,005,370 | A | 4/1991 | Tanaka et al. |
| 5,127,237 | A | 7/1992 | Sendo et al. |
| 5,303,864 | A | 4/1994 | Hirota |
| 5,555,739 | A | 9/1996 | Kujirai et al. |
| 5,924,299 | A | 7/1999 | Karl |
| 5,957,376 | A | 9/1999 | Fujimoto et al. |

FOREIGN PATENT DOCUMENTS

| | | |
|---|---|---|
| EP | 0713 063 A1 | 5/1996 |
| JP | 08159616 | 6/1996 |
| JP | 09144942 | 6/1997 |

OTHER PUBLICATIONS

Communication from European Patent Office for application No. 99102254, dated Sep. 25, 2000.

*Primary Examiner*—William E. Tapolcai
(74) *Attorney, Agent, or Firm*—Armstrong, Westerman & Hattori, LLP.

(57) ABSTRACT

A valve body 30 of an expansion valve 10' is equipped with a first passage 32' formed by a cutting process through which a high-pressure refrigerant travels, and on the lower portion of the valve body 30 is formed a space 35*a* defining a valve chamber 35' from the bottom portion of the valve body 30 along the axial direction by a passage 33. The passage 33 defining the space 35*a* and the first passage 32' are formed so as to interfere with each other, and at the interference area is formed a throttle portion 323. That is, the diameter of the first passage 32' is formed so that the cross-sectional area thereof is gradually reduced toward the direction of the valve chamber 35, and a throttle portion 323 is formed to the area of the first passage 32' interfering with the passage 33 defining the valve chamber 35'. The throttle portion 323 is formed to have a cross-sectional area corresponding to a diameter of approximately 3 mm. By such structure, the bubbles mixed inside the liquid-phase refrigerant is fined, and refrigerant passage noise is reduced.

1 Claim, 5 Drawing Sheets

Fig. 3

| | stationary state | starting state |
|---|---|---|
| prior art | 52.5 dB | 57.0 dB |
| present invention | 51.5 dB | 54.0 dB |

EXPANSION VALVE

This is a division of application Ser. No. 09/247,545 filed Feb. 10, 1999, now U.S. Pat. No. 6,394,360.

BACKGROUND OF THE INVENTION

The present invention relates to an expansion valve for controlling the flow rate of a refrigerant to be supplied to an evaporator in a refrigeration cycle of a refrigerator, an air conditioning device and so on.

This type of expansion valve is used in the refrigeration cycle of an air conditioning device in vehicles and the like, as well-known in the prior art. FIG. 4 shows one example of a vertical cross-sectional view of a widely used prior art expansion valve together with an outline of the refrigeration cycle. FIG. 5 is a schematic view of the valve body in the expansion valve, and FIG. 6 is a front view of the expansion valve of FIG. 4 viewed from direction A. The expansion valve 10 comprises a valve body 30 made of aluminum and having a substantially prismatic shape, to which are formed a first passage 32 of a refrigerant pipe 11 in the refrigeration cycle mounted in the portion from the refrigerant exit of a condenser 5 through a receiver 6 toward the refrigerant entrance of an evaporator 8 through which a liquid-phase refrigerant travels, and a second passage 34 of the refrigerant pipe 11 mounted in the portion from the refrigerant exit of the evaporator 8 toward the refrigerant entrance of a compressor 4 through which a gas-phase refrigerant travels. The passages are formed so that one passage is positioned above the other passage with a distance in between. Further, in FIGS. 5 and 6, reference number 50 show bolt inserting holes for mounting the expansion valve 10.

On the first passage 32 is formed an orifice 32*a* where adiabatic expansion of the liquid-phase refrigerant supplied from the refrigerant exit of the receiver 6 is to be performed. On the entrance side of the orifice 32*a* or upper stream side of the first passage is formed a valve seat, and a spherical valve means 32*b* supported by the valve member 32*c* from the upper stream side is positioned on the valve seat. The valve member 32*c* is fixed to the valve means by welding, and positioned between a biasing means 32*d* of a compression coil spring and the like, thereby transmitting the bias force of the biasing means 32*d* to the valve means 32*b*, and as a result, biasing the valve means 32*b* toward the direction approaching the valve seat. By the above-mentioned operation, the opening of the valve is adjusted.

The first passage 32 to which the liquid-phase refrigerant from the receiver 6 is introduced acts as the passage for the liquid-phase refrigerant. An entrance port 321 connected to the receiver 6 and a valve chamber 35 connected to the entrance port 321 is formed to the valve body 30, wherein a valve means 32*b* is positioned inside the valve chamber 35. An exit port 322 is connected to the evaporator 8. The valve chamber 35 is a chamber with a bottom formed coaxially with the orifice 32*a*, and is sealed by a plug 39, which acts as an adjusting screw. The plug 39 is movably screwed in the advancing or retreating direction onto a mounting hole 39' communicated to the valve chamber 35, for controlling the pressurizing force of the coil spring. The plug 39 is equipped with an o-ring 39*a*, so as to secure the sealed state between the valve body 30.

Moreover, the valve body 30 is equipped with a small radius hole 37 and a large radius hole 38, which is larger than the hole 37, which penetrate through the second passage 34 and are positioned coaxial to the orifice 32*a*, so as to provide driving force to the valve means 32*b* for opening or closing the orifice 32*a* according to the exit temperature of the evaporator 8. On the upper end of the valve body 30 is formed a screw hole 361 to which a power element portion 36 acting as a heat sensing portion is fixed.

The power element portion 36 comprises a diaphragm 36*a* made of stainless steel, an upper cover 36*d* and a lower cover 36*h* welded to each other with the diaphragm 36*a* positioned in between so as to each define an upper pressure housing 36*b* and a lower pressure housing 36*c* forming two sealed housings on the upper and lower areas of the diaphragm 36*a*, and a sealed tube 36*i* for sealing a predetermined refrigerant working as a diaphragm drive liquid into the interior space communicated to the upper pressure housing 36*b*, wherein the lower cover 36*h* is screwed onto the screw hole 361 with a packing 40. The lower pressure housing 36*c* is communicated to the second passage 34 through a pressure-equalizing hole 36*e* formed coaxial to the center axis of the orifice 32*a*. The refrigerant vapor from the evaporator 8 flows through the second passage 34, and therefore, the second passage 34 acts as a passage for the gas-phase refrigerant, and the pressure of the refrigerant gas is loaded to the lower pressure housing 36*c* through the pressure-equalizing hole 36*e*. Further, reference number 342 represents an entrance port from which the refrigerant transmitted from the evaporator 8 enters, and 341 represents an exit port from which the refrigerant to be transmitted to the compressor 4 exits. In FIGS. 5 and 6, the sealed tube 36*i* is omitted from the drawing.

Inside the lower pressure housing 36*c* contacting the diaphragm 36*a* is formed an aluminum heat sensing shaft 36*f* positioned slidably inside the large radius hole 38 penetrating the second passage 34, so as to transmit the refrigerant exit temperature of the evaporator 8 to the lower pressure housing 36*c* and to slide inside the large radius hole 38 in correspondence to the displacement of the diaphragm 36*a* accompanied by the difference in pressure between the lower pressure housing 36*c* and the upper pressure housing 36*b* in order to provide drive force, and a stainless steel operating shaft 37*f* having a smaller diameter than the heat sensing shaft 36*f* is positioned slidably inside the small radius hole 37 for pressing the valve means 32*b* in resistance to the elastic force of the biasing means 32*d* according to the displacement of the heat sensing shaft 36*f*, wherein the heat sensing shaft 36*f* is equipped with a sealing member, for example, an o-ring 36*g*, so as to secure the seal between the first passage 32 and the second passage 34. The upper end of the heat sensing shaft 36*f* contacts to the lower surface of the diaphragm 36*a* as the receiving portion of the diaphragm 36*a*, the lower end of the heat sensing shaft 36*f* contacts to the upper end of the operating shaft 37*f*, and the lower end of the operating shaft 37*f* contacts to the valve means 32*b*, wherein the heat sensing shaft 36*f* together with the operating shaft 37*f* constitute a valve drive shaft. Accordingly, the valve drive shaft extending from the lower surface of the diaphragm 36*a* to the orifice 32*a* of the first passage 32 is positioned coaxially inside the pressure-equalizing hole 36*e*. Further, a portion 37*e* of the operating shaft 37*f* is formed narrower than the inner diameter of the orifice 32*a*, which penetrates through the orifice 32*a*, and the refrigerant passes through the orifice 32*a*.

A known diaphragm drive liquid is filled inside the upper pressure housing 36*b* of the pressure housing 36*d*, and through the diaphragm 36*a* and the valve drive shaft exposed to the second passage 34 and the pressure equalizing hole 36*e* communicated to the second passage 34, the heat of the refrigerant vapor travelling through the second passage 34 from the refrigerant exit of the evaporator 8 is transmitted to the diaphragm drive liquid.

In correspondence to the heat being transmitted as above, the diaphragm drive liquid inside the upper pressure housing 36*b* turns into gas, the pressure thereof being loaded to the upper surface of the diaphragm 36*a*. The diaphragm 36*a* is displaced to the vertical direction according to the difference between the pressure of the diaphragm drive gas loaded to the upper surface thereof and the pressure loaded to the lower surface thereof.

The vertical displacement of the center area of the diaphragm 36*a* is transmitted to the valve means 32*b* through the valve drive shaft, which moves the valve means 32*b* closer to or away from the valve seat of the orifice 32*a*. As a result, the flow rate of the refrigerant is controlled.

The temperature of the low-pressure gas-phase refrigerant sent out from the exit of the evaporator 8 is transmitted to the upper pressure housing 36*b*, and according to the temperature, the pressure inside the upper pressure housing 36*b* is changed. When the exit temperature of the evaporator 8 rises, in other words, when the heat load of the evaporator is increased, the pressure inside the upper pressure housing 86*b* is raised, and correspondingly, the heat sensing shaft 36*f* or valve drive shaft is driven to the downward direction, pushing down the valve means 32*b*. Thereby, the opening of the orifice 32*a* is widened. This increases the amount of refrigerant being supplied to the evaporator 8, and lowers the temperature of the evaporator 8. In contrast, when the temperature of the refrigerant sent out from the evaporator 8 is lowered or heat load of the evaporator is reduced, the valve means 32*b* is driven to the opposite direction, narrowing the opening of the orifice 32*a*, reducing the amount of refrigerant being supplied to the evaporator, and raises the temperature of the evaporator 8.

SUMMARY OF THE INVENTION

In this type of expansion valves, it is preferable that only the liquid-phase refrigerant from the receiver 6 be supplied thereto. However, the gas-phase refrigerant may be mixed to the liquid-phase refrigerant inside the receiver, and there are cases where a gas-liquid phase refrigerant is transmitted to the entrance port 321. In such case, when the refrigerant including the gas-phase refrigerant travels from the entrance port 321 through the valve chamber 35 and the orifice 32*a* toward the exit port 322, refrigerant passage noise may be generated.

The present invention aims at providing an expansion valve solving the above-mentioned problem.

In order to solve the problem, the expansion valve according to the present invention comprises a valve body, a valve chamber formed inside said valve body to which a refrigerant enters from a passage where high-pressure refrigerant being transmitted to an evaporator travels, a valve means positioned inside said valve chamber for adjusting the flow rate of said refrigerant, said valve means being driven according to the temperature of a low-pressure refrigerant transmitted from said evaporator to a compressor, wherein said valve chamber includes a throttle portion formed so as to interfere with said passage, and through said throttle portion enters said refrigerant into said valve chamber.

Further, the expansion valve according to the present invention comprises a valve body including a first passage through which a high-pressure refrigerant flowing toward an evaporator travels and a second passage through which a low-pressure refrigerant flowing from said evaporator toward a compressor travels, a valve means being driven according to the temperature of said low-pressure refrigerant by a power element portion mounted to an upper end portion of said valve body, a mounting hole formed to a bottom end portion of said valve body to which an adjustment screw is movably mounted in the advancing or retreating direction for adjusting the pressurizing force of a spring for controlling the valve opening of said valve means, and a valve chamber defined by a passage being communicated to said mounting hole, wherein said expansion valve further comprises a throttle portion formed by said passage defining said valve chamber being interfered with said first passage, and through said throttle portion flows said high-pressure refrigerant traveling from said first passage into said valve chamber.

Even further, the expansion valve according to the present invention characterized in that said first passage is formed so that the diameter thereof is reduced gradually toward said valve chamber, and a wall portion is formed to the area between said first passage and said valve chamber.

As above, by forming a throttle portion connecting the first passage and the valve chamber, the bubbles inside the refrigerant may be fined, and as a result, the noise level of the refrigerant passage noise caused by the existence of bubbles may be reduced.

BRIEF DESCRIPTION OF THE DRAWINGS

FIG. 3 is a chart showing the result of the experiment measuring the noise level of the expansion valve shown in FIG. 1 and the prior art expansion valve;

PREFERRED EMBODIMENT OF THE INVENTION

The preferred embodiment of the present invention will now be explained with reference to the accompanied drawings.

Figure 1:
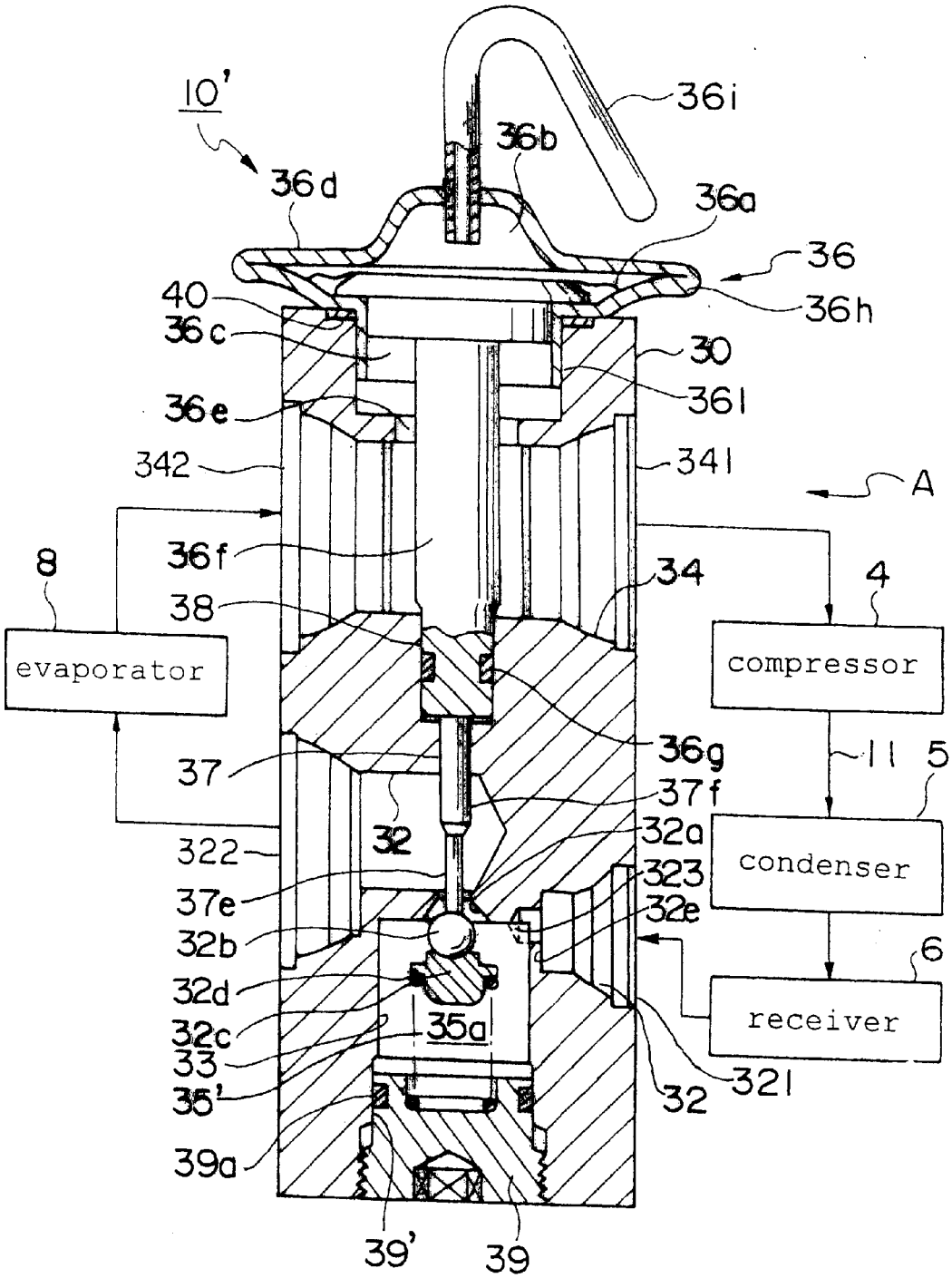
FIG. 1 is a drawing showing the cross-sectional view of one embodiment of the expansion valve according to the present invention with an outline of the refrigeration cycle.
Figure 2:
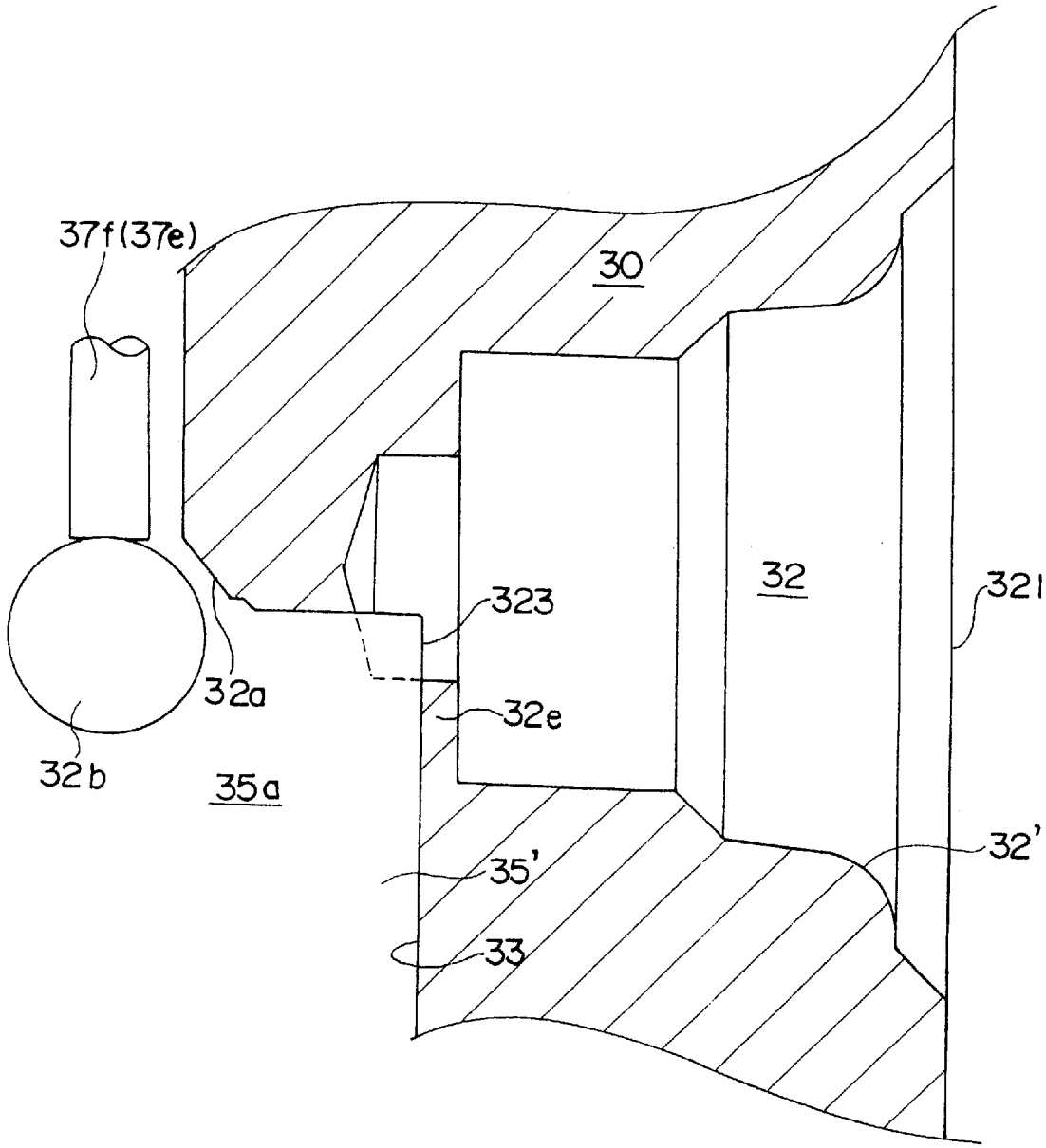
FIG. 2 is a partially enlarged view showing the main portion of the expansion valve according to the embodiment of FIG. 1.

FIG. 1 is a cross-sectional view showing one embodiment of the expansion valve according to the present invention, together with an outline of the refrigeration cycle, and FIG. 2 is a partially enlarged view showing the main areas of the expansion valve according to the embodiment shown in FIG. 1.

Figure 4:
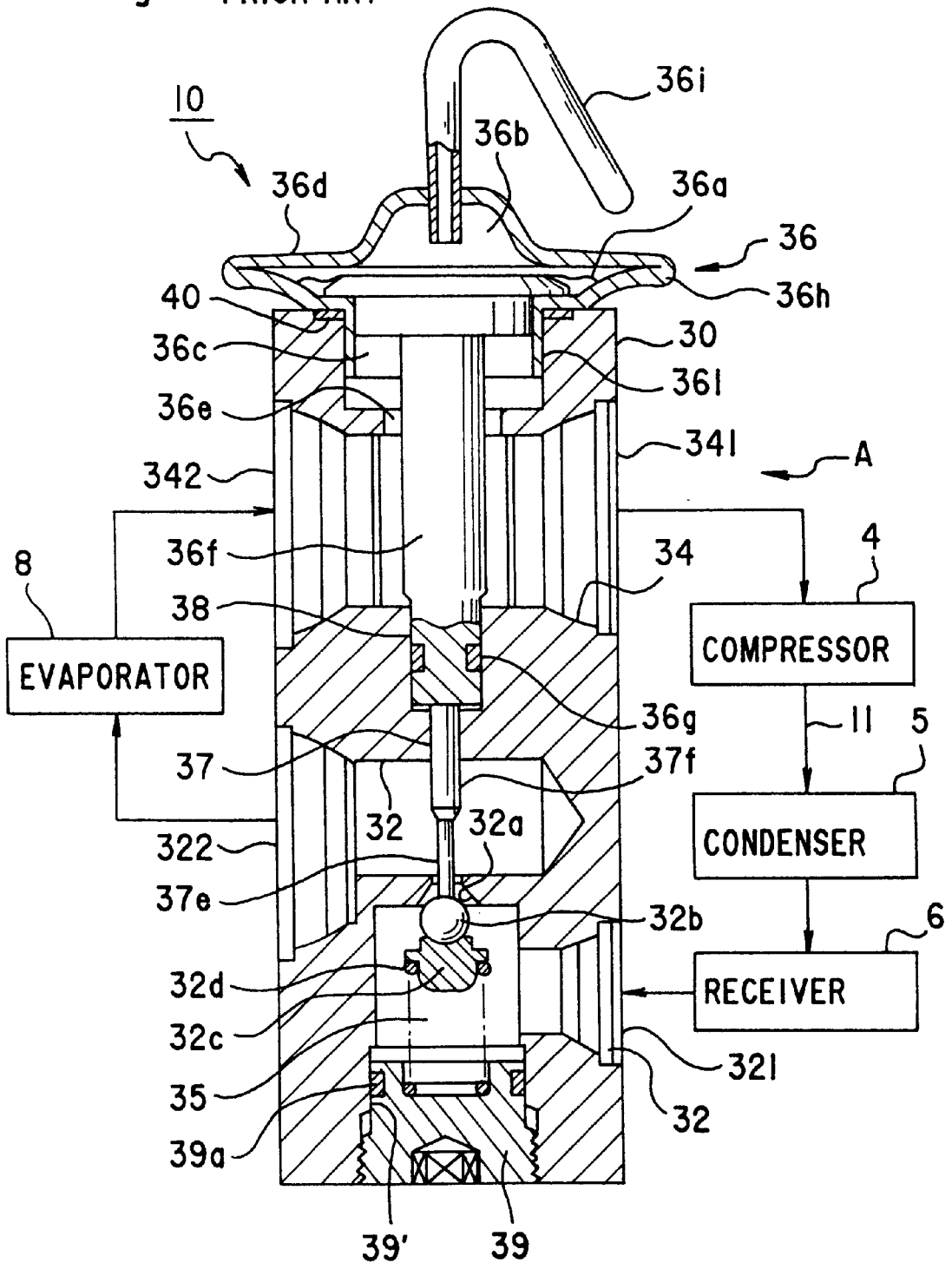
Fig.4 PRIOR ART
FIG. 4 is a view showing the cross-section of the prior art expansion valve with an outline of the refrigeration cycle.
Figure 6:
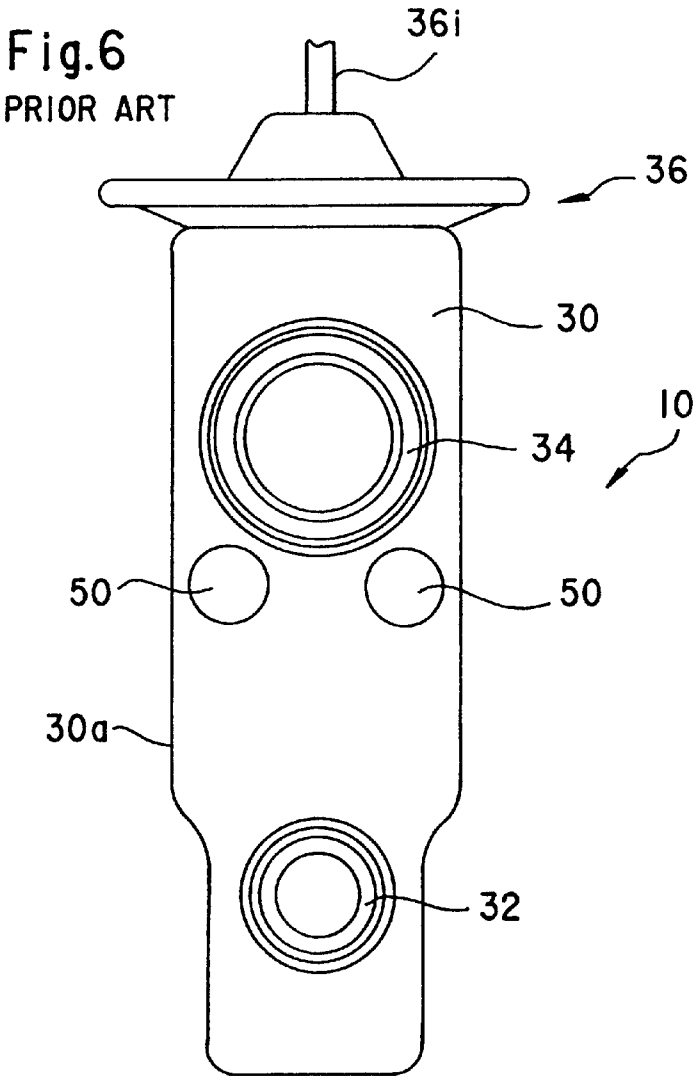
Fig.6 PRIOR ART
FIG. 6 is a front view of the prior art expansion valve.
Figure 5:
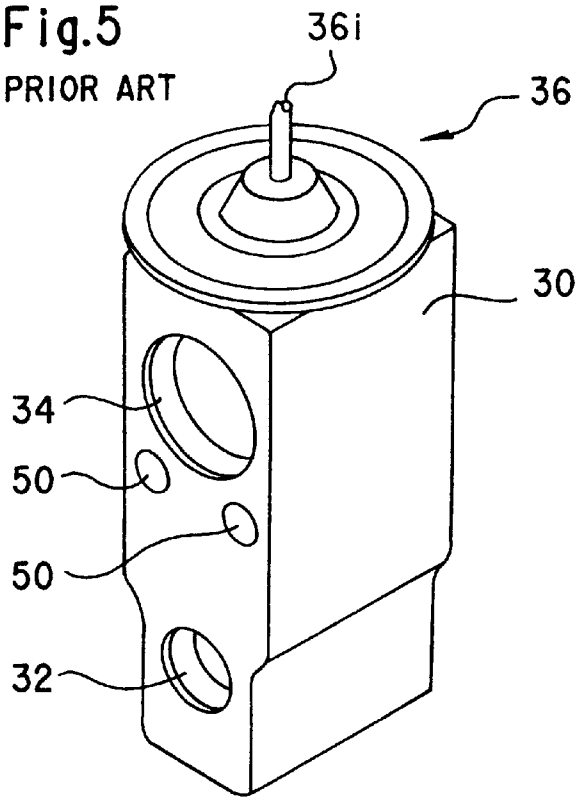
Fig.5 PRIOR ART
FIG. 5 is a schematic view of the prior art expansion valve.

In the expansion valve 10' shown in FIG. 1, only the structural condition of the passage through which the high-pressure refrigerant from the receiver travels and the passage defining the space as the valve chamber differ from the prior art expansion valve 10 shown in FIG. 4, and the other structures are the same. Therefore, the same reference numbers are provided to the same components, and the detailed explanation thereof are omitted. In FIG. 1, the expansion valve 10' comprises a first passage 32' through which high-pressure refrigerant flowing from the receiver 6 into the valve body 30 travels, and on the lower portion of the valve body 30, a space 35*a* constituting a valve chamber 35' is formed by a passage 33 from the bottom portion of the valve body 30 along the axial-direction.

The passage 33 is formed so as to be communicated to a mounting hole 39' of a plug 39. The space 35*a* is closed and sealed by a plug 39 screwed and fixed to the bottom end portion of the valve body 30, thereby constituting a valve chamber 35'. In the valve chamber 35' is stored a valve member 32*c* supporting the valve means 32*a*, and the valve means 32*b* is biased by the elastic force of a coil spring 32*d* mounted between the valve member 32*c* and the plug 39.

The first passage 32' and the passage 33 defining the space 35*a* is formed so as to interfere with one another when formed, as shown by the dotted line of FIG. 2, and a throttle portion 323 is formed at the interfering area. That is, the first passage 32' is formed, as shown in FIG. 2, so that its diameter is gradually decreased toward the direction of the valve chamber 35' and the size of the cross sectional area of the passage is thereby decreased gradually. The diameter of the entrance port 321 is approximately 14.5 mm, the diameter of the passage 32' at the area interfering with the valve chamber 35' is approximately 4.5 mm, and the first passage 32' having the cross-sectional area of said diameter is interfered with the passage 33 defining the valve chamber 35', forming a throttle portion 323. The throttle portion 323 is formed so that it has a cross-sectional area corresponding to the diameter of approximately 2 mm to 4 mm.

A wall portion 32*e* is formed to the first passage 32' between the valve chamber 35' and the portion of the first passage 32' whose diameter is smallest which constitutes the throttle portion 323, said wall portion contributing to a function of throttling the high-pressure refrigerant traveling through the first passage 32' at the throttle portion 323. That is, the high-pressure refrigerant from the receiver 6 flows in from the entrance port 321 of the first passage 32', and is gradually throttled according to the reduction of diameter of the first passage 32. Then, when it passes through the passage 32', the refrigerant is collided against and buffed by the wall portion 32*e*, and thereby, the flow of the refrigerant is bent from the first passage 32' to the throttle portion 323, and as a result, advances from the throttle portion 323 into the valve chamber 35'. The throttle portion 323 acts as an opening opened to both the first passage 32 and the valve chamber 35', communicating the first passage 32' and the valve chamber 35', and the cross-sectional area of the throttle portion comprises a cross-sectional area corresponding to a diameter of approximately 2 mm to 4 mm. The size of the throttle portion 323 is defined in the range of a cross-sectional area corresponding to a diameter between approximately 2 mm through 4 mm, since it is confirmed by experiment that the throttle portion having a diameter of approximately 4 mm or less was effective in reducing the refrigerant passage noise, and that a throttle portion having a diameter of approximately 2 mm or more was necessary in securing the flow rate of the refrigerant without increasing passage resistance.

In such structure, the high-pressure refrigerant transmitted from the receiver 6 travels through the first passage 32' to the throttle portion 323, and there, the high-pressure refrigerant collides to the wall portion 32*e* buffing the shock of bubbles, and bends its path from the first passage 32' to the throttle portion 323, advancing into the valve chamber 35'. In this throttle portion 323, the high-pressure refrigerant is throttled before being reduced of its pressure and being expanded by the valve means 32*b* and the orifice 32*a*, so that the bubbles inside the high-pressure refrigerant is fined, thereby reducing the refrigerant passage noise.

FIG. 3 shows a chart where the noise level caused by the refrigerant passage noise according to the present embodiment is compared with that of the prior art expansion valve, wherein the throttle portion 323 is formed to have a cross-sectional area corresponding to a diameter of approximately 3 mm, the room temperature is 20° C., the rotational speed of the compressor is 1000 rpm, and the air-flow of the evaporator is set to a LOW mode. The chart shows the result of the experiment where the noise was measured at an area away from the expansion valve by 10 cm under the above condition. As can be anticipated by the chart shown in FIG. 3, the present expansion valve has a greatly improved noise level compared to the prior art expansion valve at the starting and at the stationary state of the refrigeration cycle.

The operation of the valve means 32*b* and the orifice 32*a* to reduce the pressure and to expand the high-pressure refrigerant flown into the valve chamber 35' into a vapor state, and to transmit said refrigerant from the exit port 322 into an evaporator, are the same as that of the prior art expansion valve shown in FIG. 4. That is, the pressure of the upper pressure chamber 36*b* of the power element portion 36 which varies according to the temperature transmitted through the heat sensing shaft 36*f* of the refrigerant traveling through the second passage 34 acts with the refrigerant pressure from the second passage 34, which drives the valve means 32*b* to a position of balance with the force acting to the diaphragm 36*a* through the operation shaft 37*f* by the coil spring 32*d*. Thereby, the opening of the valve means 32*b* is controlled.

As mentioned above, the noise caused when the refrigerant passes may be reduced according to the present embodiment, without having to change the design of the prior art expansion valve greatly.

Further, the above-mentioned embodiment showed a state where a low-pressure refrigerant passage comprising a heat sensing shaft is positioned inside an expansion valve body for adjusting the opening of the valve means by use of a power element portion. However, the present expansion valve may also be equipped with a heat sensing pipe. Moreover, the present expansion valve may be equipped with a power element portion using a plug body, instead of the sealed tube, to seal the refrigerant.

As explained above, according to the present invention, a throttle portion is mounted to the expansion valve at the interfering area between the high-pressure refrigerant passage and the valve chamber, which effectively reduces the noise level caused when the refrigerant travels through the expansion valve.

Moreover, according to the present invention, the noise thereof may be reduced without having to change the design of the prior art expansion valve greatly.

What is claimed is:

1. The process of preventing noise caused as refrigerant passage a noise inside an expansion valve, characterized in that said expansion valve comprises a valve body, a valve chamber formed inside said valve body to which a refrigerant enters from a passage where a high-pressure refrigerant being transmitted to an evaporator travels, said passage having a smallest diameter portion and in direct contact with a corner portion of said valve chamber, a valve means positioned inside said valve chamber for adjusting said refrigerant, said valve means being driven according to the temperature of a low-pressure refrigerant transmitted from said evaporator to a compressor, wherein said valve chamber has a throttle portion formed by the interference of said valve chamber and said passage, said high-pressure refrigerant flowing into said valve chamber through said throttle portion, and a wall portion is formed adjacent to said throttle portion at the smallest portion of said passage.

* * * * *